US007681977B2

(12) United States Patent
Takayanagi

(10) Patent No.: US 7,681,977 B2
(45) Date of Patent: Mar. 23, 2010

(54) TEMPERATURE DETECTION CIRCUIT FOR RECORDING HEAD AND RECORDING DEVICE THEREWITH

(75) Inventor: Yoshiaki Takayanagi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 357 days.

(21) Appl. No.: 11/696,014

(22) Filed: Apr. 3, 2007

(65) Prior Publication Data

US 2007/0165249 A1 Jul. 19, 2007

Related U.S. Application Data

(63) Continuation of application No. 10/990,673, filed on Nov. 16, 2004, now Pat. No. 7,237,863.

(30) Foreign Application Priority Data

Nov. 17, 2003 (JP) ..... 2003-386940

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 6,890,097 B2 5/2005 Tanaka

*Primary Examiner*—Julian D Huffman
(74) *Attorney, Agent, or Firm*—Canon USA Inc IP Div

(57) ABSTRACT

A recording head performing recording with thermal energy and having a temperature sensor. The sensor measures the temperature of the recording head with minimal susceptibility to common mode noise. The sensor includes a p-n junction of a semiconductor provided inside the recording head. Temperature detection is performed by converting a first voltage value at a P-side portion of the sensor and a second voltage value at a N-side portion of the sensor into respective digital data. A difference data of the respective digital data is calculated. Based on the difference data, the temperature of the recording head can be determined.

1 Claim, 7 Drawing Sheets

| ΔVF [hex] | HEAD TEMPERATURE [°C] |
|---|---|
| DATA 0 | 0 |
| ... | ... |
| ... | ... |
| DATA 25 | 25 |
| ... | ... |
| ... | ... |
| DATA 50 | 50 |
| ... | ... |
| DATA 80 | 80 |
| ... | ... |

TEMPERATURE DETECTION CIRCUIT FOR RECORDING HEAD AND RECORDING DEVICE THEREWITH

CROSS REFERENCE TO RELATED APPLICATIONS

This is a continuation of co-pending U.S. patent application Ser. No. 10/990,673 filed Nov. 16, 2004, which claims the benefit of Japanese Application 2003-386,940, filed Nov. 17, 2003, both of which are incorporated by reference herein in their entirety.

BACKGROUND OF THE INVENTION

1. Field of the Invention

The present invention relates to an image recording device, and more specifically to a temperature detection circuit that detects the temperature of a recording head performing image recording using thermal energy.

2. Description of the Related Art

Recording devices that record information such as desired characters and images, on sheet-shaped recording media such as paper and films, are widely used as information output devices for word processors, personal computers, facsimiles, etc.

As recording systems for recording devices, a variety of systems are known. Among them, the ink jet system has received special attention in recent years because it allows non-contact recording on a recording medium such as paper, facilitates colorization, and is superior in quietness. Out of the ink jet system, the serial recording system has been in general use because of its inexpensiveness, easiness in miniaturization, and the like. The serial recording system includes a recording head that discharges ink in accordance with desired recording information, and wherein recording is performed while conducting a reciprocating scan in a direction intersecting the feed direction of a recording medium such as paper.

In an ink jet recording device, an image is formed by discharging ink from a plurality of nozzles (discharge orifices) provided in a recording head onto a recording medium. In order to maintain satisfactory quality of the image formed in this manner, it is important to maintain constant size of ink drops, or the discharge amount of ink.

In an ink jet recording device that discharges ink drops using thermal energy, the size of ink drops generally depends on energy supplied for the discharge of ink drops, and the temperature of the recording head. The size of ink drops increases with the increase in the supplied energy or the head temperature. Therefore, in order to maintain constant size of ink drops, it is necessary to detect the temperature of the recording head, and control the energy to be supplied in accordance with the detected temperature.

Such temperature detection methods for a recording head are disclosed in patent documents, such as U.S. Pat. Nos. 5,638,097; 5,485,182; and 5,760,797; and Japanese Patent Laid-Open No. 5-050590.

As set forth in these patent documents, examples of known inexpensive temperature detection methods for a recording head include a method in which the temperature characteristic of the voltage drop (i.e., forward voltage drop in a diode) in a p-n junction of a semiconductor is used.

FIG. 7 is a perspective view showing a constructional example of a recording head. Reference numeral 100 denotes a heater board (element substrate), which is constructed by forming an electrothermal transducer (discharge heater) 105 and wiring 106 made of Al or the like for supplying power to the electrothermal transducer 105, on a silicon substrate by a deposition technique. A top plate 130 having partition walls for forming liquid passages (nozzles) 125 for a recording liquid such as ink, is adhered to the heater board 100, and thereby a recording head is formed.

Ink is supplied to a common liquid chamber 123 through a supply port 124 provided in the top plate 130, and is introduced from the common liquid chamber 123 into each nozzle 125. When the heater 105 is heated by energization, ink filled in the nozzles 125 generates bubbles, and ink drops are discharged from discharge orifices 126.

FIG. 8 is a plan view of the heater board 100 shown in FIG. 7. Reference numeral 5 denotes a discharge heater, and 4 denotes terminals to be connected to the outside by wire bonding. Reference numeral 2 denotes temperature sensors for temperature detection, each of which comprises a diode cell formed having the same size as that of a diode cell serving as a function element to be described later (in FIG. 8, A=B). Reference numeral 8 denotes a diode cell group for driving in which each diode cell comprises a diode function element having the same size as that of temperature sensor 2 . Use of this diode cell group allows the discharge heater 5 to be selectively driven in accordance with image data.

Because the temperature sensors 2 are each formed as a function element comprising diodes or the like by semiconductor deposition processes as in the case of other portions, they can have a very high degree of accuracy. Furthermore, providing the temperature sensors 2 at both ends of the heater board (as shown in FIG. 8) allows the distribution state of the substrate temperature in the array direction of the nozzles to be grasped from outputs of the temperature sensors.

FIG. 9A is a diagram showing a construction wherein a diode 20 comprising a p-n junction is formed on the heater board 100 , and wherein the diode 20 is used as a temperature sensor 2 by using its diode characteristic. As can be seen from FIG. 9A, Al electrode wiring 18 is led out from each of the p-region and n-region of the diode 20 , and an insulating layer 19 of $SiO_2$ is formed between the substrate surface and the diode 20 .

FIG. 9B shows an equivalent circuit of the diode shown in FIG. 9A. In FIG. 9B, when a current flows from "A" towards "B",a forward voltage drop VF in the diode occurs. In general, the forward voltage drop VF varies in accordance with temperature variation, and the detection of temperature is performed by making use of this variation.

FIG. 1 shows an example of a conventional temperature detection circuit using a diode sensor. The pre-stage circuit is a constant-current circuit for feeding a constant current through the diode sensor. Specifically, the constant current determined by a voltage Vref divided by resistors 10 and 11 , and the resistance value R1 of the resistor 12 , that is, Vref/R1 flows through the diode sensor 14 irrespective of the environmental temperature during temperature detection, this current value being, for example, on the order of 200 μA.

The voltage drop VF in the diode sensor 14 relative to the point "a" in FIG. 1 decreases with the increase in temperature, as indicated by a straight line 22 . The temperature gradient at this time is, for example, −2.1 mV/° C. Therefore, provided that the temperature of the recording head increases by 55° C., for example, from 25° C., which is room temperature, to 80° C., which is a detected temperature indicating an excessive temperature rise of the head, the voltage drop VF decreases by 115 mV (that is, ΔVF =−115 mV).

On the other hand, the post-stage circuit shown in FIG. 1 is a voltage amplification circuit, which amplifies the variation ΔVF of the voltage drop VF in the diode sensor 14, detected in the pre-stage constant current circuit in accordance with a gain determined by the ratio of the resistance value R3 of the resistor 16 to the resistance value R2 of the resistor 15, that is, R3/R2. In this manner, ΔVF is amplified as shown by the straight line 24 in FIG. 2 so that ΔVF fits to the dynamic range of the analog/digital converter (A/D converter).

Here, if we suppose that the dynamic range of the A/D converter is 2.5 V, and that its resolution is 8 bits, i.e., 256 steps, then 1 step corresponds to 9.77 mV. Therefore, the absolute value (=115 mV) of the variation ΔVF (=−115 mV) of VF corresponds to 12 steps. This results in utilizing only a range corresponding to about 5% of the dynamic range 2.5 V. In this way, the conventional temperature detection circuit is difficult to make an effective use of the dynamic range of the A/D converter. This makes the conventional temperature detection circuit susceptible to noise. Also, in the construction shown in FIG. 1, with no noise provided, the inputs V+ and V− of the operational amplifier 13 are equal to each other, and maintain a state of equilibrium. However, when positive noise due to common mode noise or the like intrudes on the wiring connected to the diode sensor 14, the absolute value of V− may become higher than that of V−, thereby producing a loss of equilibrium. In such a case, the potential at the point "b" in FIG. 1 enters a low level, and herein, undesirably becomes 0 V. Conversely, when negative noise intrudes on the wiring, the potential at the point "b" in FIG. 1 enters a high level and undesirably becomes Vcc. In this manner, the construction as shown in FIG. 1 is susceptible to noise connected to the diode sensor 14, thereby causing a possibility of erroneously detecting an excessive temperature rise.

Furthermore, as is well known, the A/D converter generally maintains the linearity in the vicinity of the center of the dynamic range as shown in FIG. 3, but tends to lose the linearity in the regions near the power supply voltages, i.e., 0 V and Vcc.

FIG. 3 is a graph showing, by comparison, an example of the characteristic of an ideal A/D converter and that of the characteristic of a low-cost A/D converter, which cannot maintain the above-described linearity. The dotted line 30 in FIG. 3 represents an example of the input/output characteristic of the ideal A/D converter, while the solid line 32 represents that of the characteristic of a low-cost A/D converter. As illustrated in FIG. 3, the low-cost A/D converter exhibits linearity in the region indicated by "C",near the center of the dynamic range, but it loses the linearity in the "A" and "B" regions in the vicinity of both ends of the dynamic range, i.e., near the power supply voltages (0 V and Vcc). Although an A/D converter improved in such a tendency is available, it is generally expensive.

SUMMARY OF THE INVENTION

The present invention is directed to a recording head that performs recording using thermal energy and capable of correctly detecting temperature of the recording head with a simple and inexpensive arrangement.

According to one aspect of the present invention, a recording device having a recording head operable to perform recording using thermal energy, includes: a sensor having a p-n junction of a semiconductor and being disposed inside the recording head, wherein the p-n junction includes a P-side portion and a N-side portion; an analog/digital converter that converts a first voltage value at the P-side portion of the sensor into a first digital data and converting a second voltage value at the N-side portion into a second digital data; and a difference calculator calculating a difference data of the first and second digital data.

According to another aspect of the present invention, a temperature detection circuit of a recording head that performs recording using thermal energy, includes: a function element having a p-n junction of a semiconductor and being disposed inside the recording head, the p-n junction having a P-side portion and a N-side portion; an analog/digital converter converting a first voltage value at the P-side portion into a first digital data and converting a second voltage value at the N-side portion into a second digital data; difference acquisition means for determining a difference data of first and second digital data; and temperature determining means for determining a temperature of the recording head based on the difference data.

According to still another aspect of the present invention, a method for measuring a temperature of a recording head that uses thermal energy to perform recording, the method including the following steps: providing a sensor having a p-n junction of a semiconductor, wherein the p-n junction includes a P-side portion and a N-side portion; digitally converting a first voltage value at the P-side junction into a first digital data; digitally converting a second voltage value at the N-side portion into a second digital value; calculating a difference data of the first and second data; and determining the temperature of the recording head based on the difference data.

Further features and advantages of the present invention will become apparent from the following description of the embodiments with reference to the attached drawings.

DESCRIPTION OF THE EMBODIMENTS

Hereinafter, embodiments of the present invention will be described in detail with reference to the accompanying drawings. It is, however, to be understood that components set forth in these embodiment are illustrative, and that the present invention is not limited to the specific embodiments thereof except as defined in the appended claims.

In the description, the term "recording" (also referred to as "print" hereinafter) not only includes the formation of significant information such as characters and graphics, but also broadly includes the formation of images, figures, patterns, and the like on a recording medium, or the processing of the recording medium, irrespective of whether they are significant or insignificant, and whether they are visualized so as to be perceivable by humans.

The term "recording medium" not only includes a paper sheet used in common recording devices, but also broadly includes materials capable of accepting ink, such as a cloth, a plastic film, a metal plate, glass, a ceramic, wood, and leather.

The term "ink" (also referred to as "liquid" hereinafter) should be extensively interpreted similarly to the definition of "recording" (or "print") described above. That is, the term "ink" includes a liquid that, by being applied onto the recording medium, can be used for forming images, figures, patterns and the like, for processing the recording medium, or for processing ink (e.g., for solidifying or insolubilizing a colorant contained in ink applied onto a recording medium).

The term "nozzle",unless otherwise specified, collectively refers to a discharge orifice, a liquid passage communicating therewith, and an element for generating energy used for ink discharge. The "nozzle" corresponds to a "recording element".

The term "element substrate" to be used hereinafter not only refers to a substrate comprising a silicon semiconductor, but also refers to a substrate including various elements, wiring and the like installed thereon".

Also, the term "on an element substrate" refers not only to "on an element substrate" in a literal sense, but also to "on the surface of an element substrate, and in addition, on the inside of an element substrate in the vicinity of its surface". Furthermore, the term "built-in" used in the present invention does not refer to merely "arranging various discrete elements on a substrate", but refers to "manufacturing by integrally forming various elements on an element substrate by a semiconductor circuit manufacturing process or the like".

Description of Ink Jet Recording Device

Figure 10:
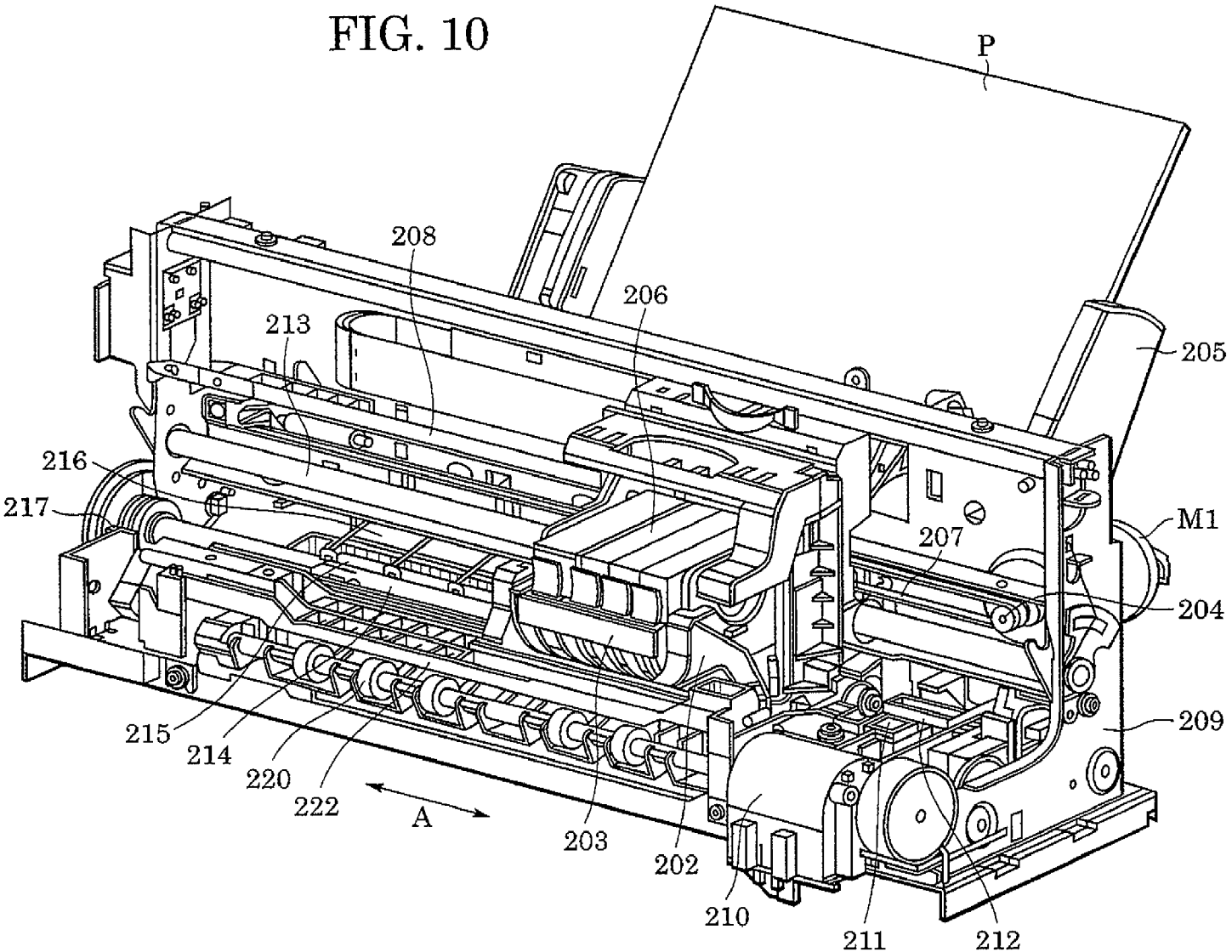
FIG. 10 is a perspective view of an ink jet recording device incorporating the temperature detection circuit shown in FIG. 4.

FIG. 10 is a perspective view of an ink jet recording device incorporating a temperature detection circuit according to the present invention.

As shown in FIG. 10, the ink jet recording device (hereinafter, simply referred to as "recording device") includes a carriage motor M1 that can transmit a driving force through a transmission mechanism 204 to a carriage 202, thereby reciprocating the carriage 202 in the direction of an arrow A in FIG. 10. The carriage is equipped with a recording head 203, which performs recording by discharging ink according to the ink jet method. Simultaneously, the recording device supplies a recording medium P such as a paper sheet through a paper feed mechanism 205, and after having conveyed it to a recording position, performs printing by discharging ink from the recording head 203 onto the recording medium P in the recording position.

Also, in order to maintain the recording head 203 in a satisfactory state, the recording device intermittently performs discharge recovery processing with respect to the recording head 203 by moving the carriage 202 to the position of a recovery device 210.

The carriage 202 of the recording device is equipped with not only the recording head 203 but also an ink cartridge 206 for storing ink to be supplied to the recording head 203. The ink cartridge 206 is detachable with respect to the carriage 202.

The recording device shown in FIG. 10 is capable of color recording, and for this purpose, the carriage 202 has four ink cartridges containing magenta (M), cyan (C), yellow (Y), and black (B) inks. These four ink cartridges are detachable independently of one another.

The carriage 202 and the recording head 203 are arranged so that the joint surfaces of the two members properly contact each other to establish and maintain a required electrical connection therebetween. The recording head 203 performs recording by selectively discharging ink from a plurality of discharge orifices by applying energy in accordance with a recording signal. In particular, the recording head 203 according to this embodiment, adopting an ink jet method for discharging ink using thermal energy, has electrothermal transducers for generating thermal energy. The electrical energy applied to the electrothermal transducers is converted into thermal energy, which is supplied to the ink to cause film boiling. This film boiling causes the growth and contraction of bubbles, thereby bringing about a pressure change. The recording head 203 discharges the ink from the discharge orifices by utilizing this pressure change. These electrothermal transducers are provided to respective discharge orifices, and the ink is discharged from the respective discharge orifices by applying pulse voltages to the respective electrothermal transducers in accordance with respective recording signals.

As shown in FIG. 10, the carriage 202 is connected to a portion of a drive belt 207 of the transmission mechanism 204 for transmitting a driving force of the carriage motor M1, and is slidably supported and guided along a guide shaft 213 in the arrow A direction in FIG. 10. Accordingly, the carriage 202 is reciprocated along the guide shaft 213 by forward and reverse rotations of the carriage motor M1. A scale 208 for indicating the absolute position of the carriage 202 is provided along the moving direction (arrow A direction) of the carriage 202. In this embodiment, a transparent PET film on which black bars are printed at a required pitch is used as the scale 208. One end of the scale 208 is fixed to a chassis 209 while the other end thereof is supported by a leaf spring (not shown).

The recording device has a platen (not shown) opposite to a discharge orifice surface of the recording head 203 where the discharge orifices (not shown) of the recording head 203 are formed. While the carriage 202 equipped with the recording head 203 is reciprocated by a driving force of the carriage motor M1, a recording signal is supplied to the recording head 203 to discharge the ink, thereby performing recording across the full width of the recording medium P delivered onto the platen.

Referring again to FIG. 10, reference numeral 214 denotes a conveying roller that is driven by a conveying motor M2 (not shown) to convey the recording medium P, numeral 215 denotes pinch rollers abutting the conveying roller 214 against the recording medium P using a spring (not shown), numeral 216 denotes pinch roller holders rotatably supporting the pinch roller 215, and numeral 217 denotes a conveying roller gear fixed to one end of the conveying roller 214 . The conveying roller 214 is driven by a rotational force of the conveying motor M2 transmitted through an intermediate gear (not shown) to the conveying roller gear 217 .

Also, reference numeral 220 designates discharge rollers for discharging, to the outside of the recording device, the recording medium P on which an image has been formed by the recording head 203. The discharge rollers 220 are driven by a rotational force transmitted from the conveying motor M2. The discharge rollers 220 are abutted against the recording medium P by spur rollers (not shown) in press-contact with the discharge rollers 220 using a spring (not shown). Reference numeral 222 designates a spur holder rotatably supporting the spur rollers.

Moreover, as shown in FIG. 10, the recording device has the recovery device 210 for recovering discharge failure in the recording head 203 at a desired position (e.g., position corresponding to a home position) outside the range of the reciprocating motion of the carriage 202 equipped with the recording head 203 for recording operation (i.e., outside the recording area).

The recovery device 210 includes a capping mechanism 211 for capping the discharge orifice surface of the recording head 203, and a wiping mechanism 212 for wiping the discharge orifice surface of the print head 203. The recovery device 210 performs discharge recovery processing of forcibly discharging the ink from the discharge orifices by suction means (suction pump or the like) in the recovery device, in interlock with a capping operation with respect to the discharge orifice surface by the capping mechanism 211, thereby removing viscosity-increased ink, bubbles, and the like from the ink passages of the recording head 203.

In a non-recording period, the discharge orifice surface of the recording head 203 is capped by the capping mechanism 211, thereby protecting the recording head 203 and preventing evaporation and drying of the ink. On the other hand, the wiping mechanism 212, disposed in the vicinity of the capping mechanism 211, wipes out ink droplets adhered to the discharge orifice surface of the recording head 203.

The capping mechanism 211 and the wiping mechanism 212 enable a normal ink discharge state to be maintained in the recording head 203.

Control Configuration of Inkjet Recording Device

Figure 11:
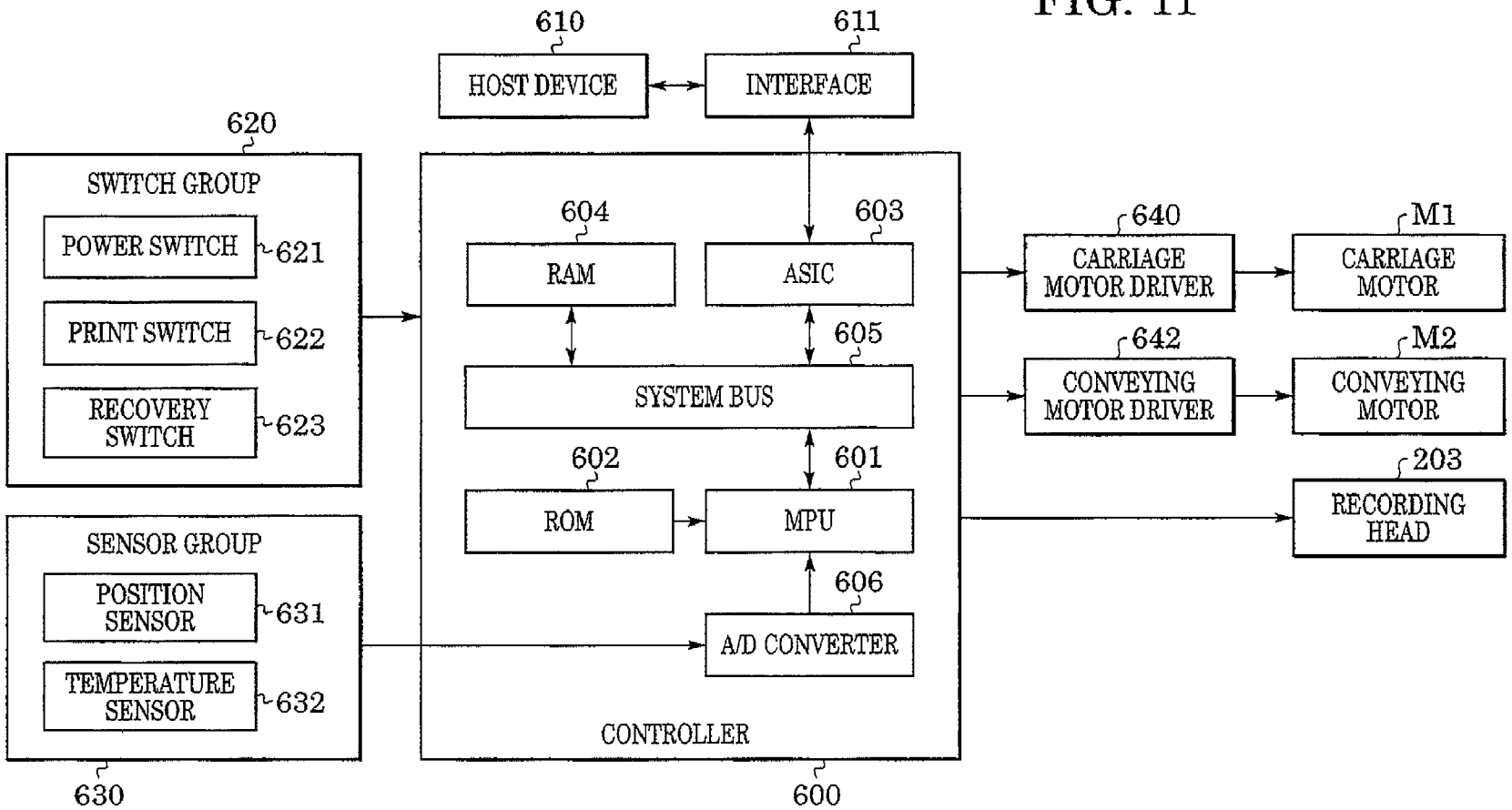
FIG. 11 is a block diagram showing a control configuration of the recording device shown in FIG. 10.

FIG. 11 is a block diagram showing a control configuration of the recording device shown in FIG. 10.

Referring to FIG. 11, a controller 600 includes a microprocessing unit (MPU) 601; a ROM 602 storing a program corresponding to a control sequence to be described later, a required table and other fixed data; an Application Specific Integrated Circuit (ASIC) 603 for controlling the carriage motor M1 and the conveying motor M2, and generating a control signal for the recording head 203; a RAM 604 including an expansion area of image data and a work area for program execution; a system bus 605 interconnecting the MPU 601, the ASIC 603, and the RAM 604 for data transmission/reception; and an A/D converter 606 for inputting analog signals from a sensor group to be described below, then A/D-converting the signals and supplying digital signals to the MPU 601.

Also, in FIG. 11, reference numeral 610 designates a computer (e.g., an image reader, digital camera, or the like) serving as an image data supply source, which is referred to as a host device. Image data, commands, status signals, and the like are transmitted/received between the host device 610 and the recording device through an interface (I/F) 611.

Reference numeral 620 designates a switch group comprising switches for receiving instruction inputs from an operator, such as a power switch 621, a print switch 622 used to start printing, and a recovery switch 623 used to start processing (recovery processing) to maintain a satisfactory ink discharge performance of the recording head 203. Reference numeral 630 designates a sensor group for detecting a device status, including a position sensor 631 such as a photo coupler for detecting a home position h, and a temperature sensor 632 provided in an appropriate position in the recording device for detecting an environmental temperature.

Also, reference numeral 640 designates a carriage motor driver for driving the carriage motor M1 to cause the carriage 202 to make a reciprocating scan in the arrow A direction, and numeral 642 designates a conveying motor driver for driving the conveying motor M2 to convey the recording medium P.

When recording scan by the recording head 203 is to be performed, the ASIC 603 transfers drive data (DATA) with respect to recording elements (discharge heaters) to the recording head 203 while directly accessing the storage area on the RAM 604.

Temperature Detection Circuit

Figure 4:
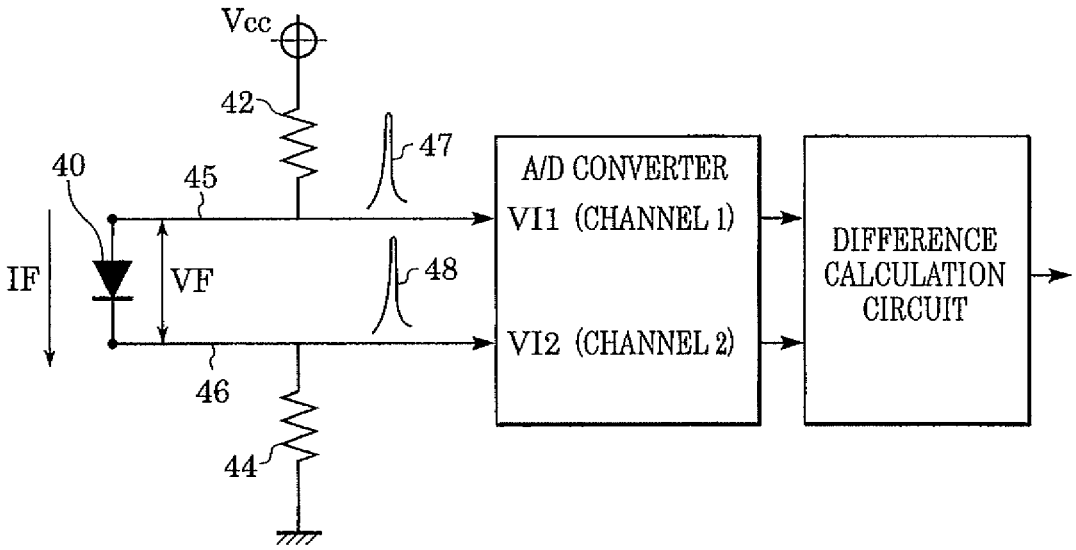
FIG. 4 is a diagram showing a main portion of a temperature detection circuit according to one embodiment of the present invention.
Figure 7:
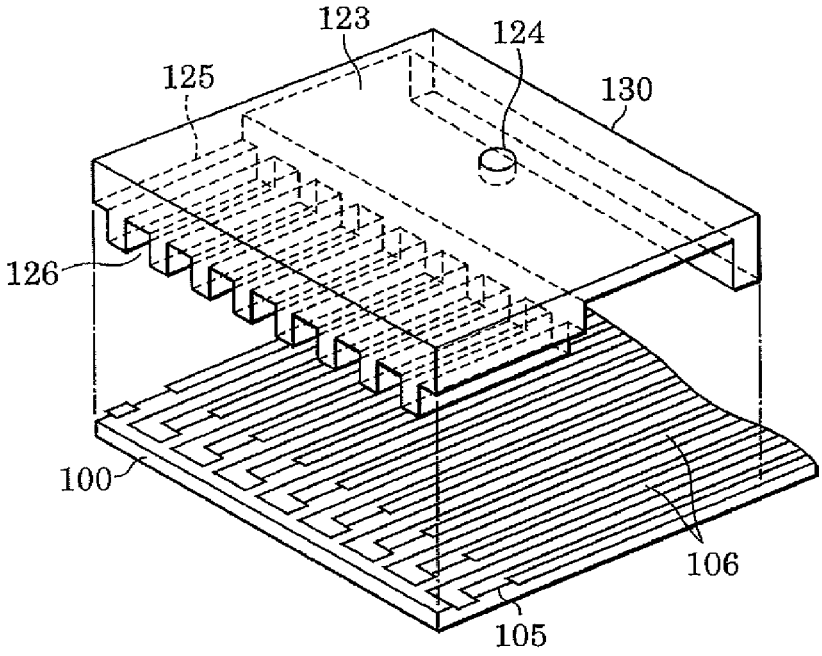
FIG. 7 is a perspective view showing a constructional example of a recording head.
Figure 8:
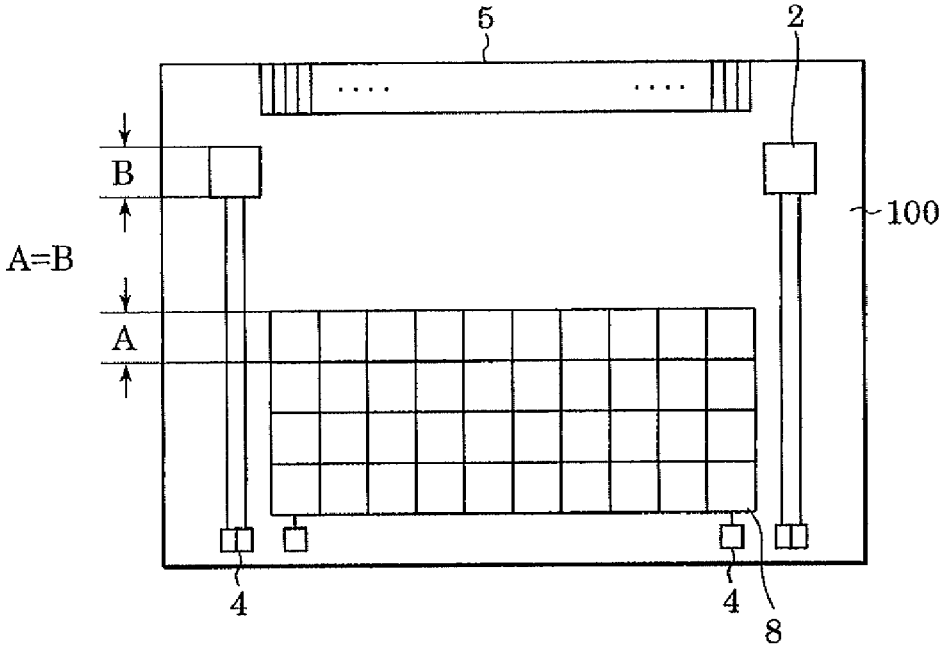
FIG. 8 is a plan view of the heater board shown in FIG. 7.
Figure 9A:
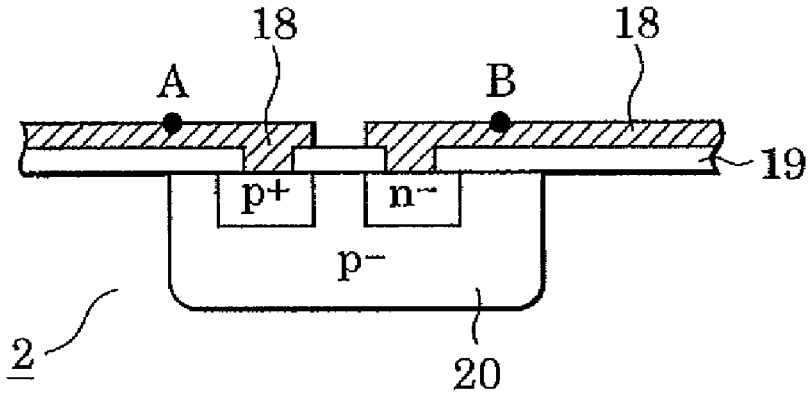
FIGS. 9A and 9B, respectively, show the construction of a temperature sensor and an equivalent circuit of the diode shown in FIG. 9A.
Figure 9B:
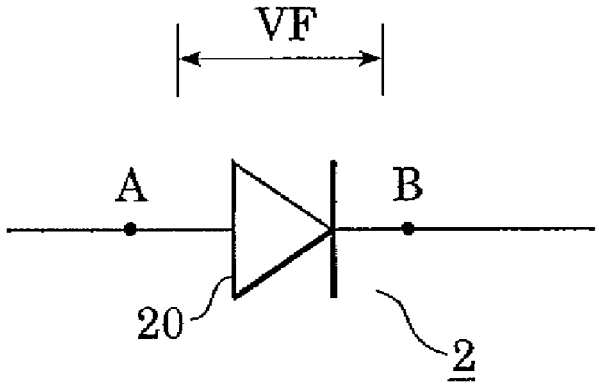

FIG. 4 is a diagram showing a main portion of a temperature detection circuit according to one embodiment of the present invention, suitable for detecting the temperature of the recording head 203 of the ink jet recording device as described above. Here, the construction of a recording head 203 and that of a heater board (element substrate) on which a temperature detection circuit is formed, and that of a diode sensor are the same as the ones described above with reference to FIGS. 7 to 9.

In this embodiment, resistors 42 and 44, respectively, are connected to an anode side and a cathode side of a diode sensor 40. Hence, a current IF flowing through the diode sensor 40 is determined by the following equation.

$$IF=(Vcc-VF)/(R42+R44)$$

Here, VF denotes a forward voltage drop in the diode sensor 40, R42 denotes the resistance value of the resistor 42, and R44 denotes the resistance value of the resistor 44. Suppose, for example, Vcc is 2.5 V and IF is 200 μA. Then, given that, at an environmental temperature of 25° C., the values of VF vary in the range of about 0.62 to about 0.65 V on an individual basis, R42 and R44 are obtained by the following expression:

$$R42 + R44 = (2.5 - (0.62 \text{ to } 0.65))/200 \ [\mu A]$$

$$= 9.25 \text{ to } 9.4 \ [k\Omega]$$

Therefore, if it is assumed that R42=R44, then R42 and R44 should be each set to 4.625 to 4.7 [kΩ].

The important point here is that the VF characteristics of the diode sensors vary to some extent from sensor to sensor at a predetermined temperature, e.g., at room temperature 25° C., but that the temperature change rate, i.e., the change rate of VF per degree centigrade is constant provided the current value is constant. For example, if IF=200 μA, the temperature change rate of VF is −2.1 mV/° C. This issue is described in detail in the above-described patent documents and the like, and hence an explanation thereof is omitted here.

Hence, detecting the voltage difference between the voltage value of the anode and that of the cathode in the diode sensor 40, and monitoring this variation allow the temperature around the diode sensor to be correctly known. For this purpose, in this embodiment, the circuit is constructed so as to detect the potential between the anode and the cathode of the diode sensor 40. Specifically, as shown in FIG. 4, a voltage value (potential) VI1 on the anode side of the diode sensor 40 and a voltage value (potential) VI2 on the cathode side thereof are inputted into two respective channels of the A/D converter. Then, the difference between the two A/D converted values is calculated, and the temperature corresponding to a signal is determined.

That is, according to the present invention, in order to detect the temperature of the recording head 203 that performs recording using thermal energy, a function element having a p-n junction of a semiconductor is provided inside the recording head 203. A first voltage value in the P-side portion of this function element and a second voltage value in the N-side portion thereof are converted into respective digital data, then the difference data of digital data outputted in correspondence with the first and second voltage values is determined, and based on this difference data, the temperature of the recording head is determined.

This makes it possible to correctly determine the temperature inside the recording head by taking advantage of the temperature characteristic of the voltage drop in the p-n junction, with a simple and inexpensive arrangement.

Furthermore, according to the present invention, the voltage values on both of the P-side and N-side are converted into digital data before the difference data between the two voltage values is determined, thereby making the diode sensor 40 less subject to common mode noise.

Here, the diode sensor is configured so that its A/D converter has two channels and the voltage VI1 on the anode side and the voltage VI2 on the cathode side are inputted into the respective channels. However, when only one channel (input) of the A/D converter is provided, a switch for changing over an input to the A/D converter may be additionally installed. In any case, it is desirable to convert two inputs VI1 and VI2 into digital data by the identical A/D converter.

Figure 1:
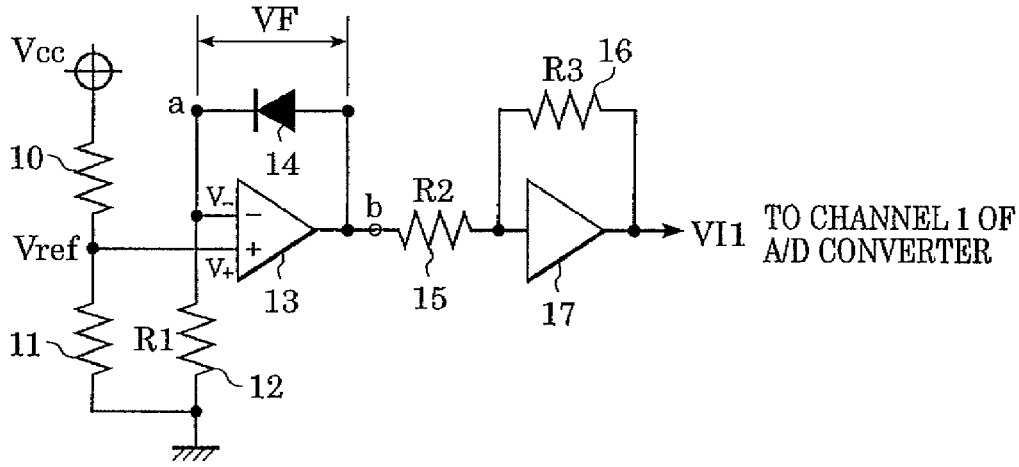
FIG. 1 PRIOR ART
FIG. 1 is a diagram of a conventional temperature detection circuit using a diode sensor.
Figure 2:
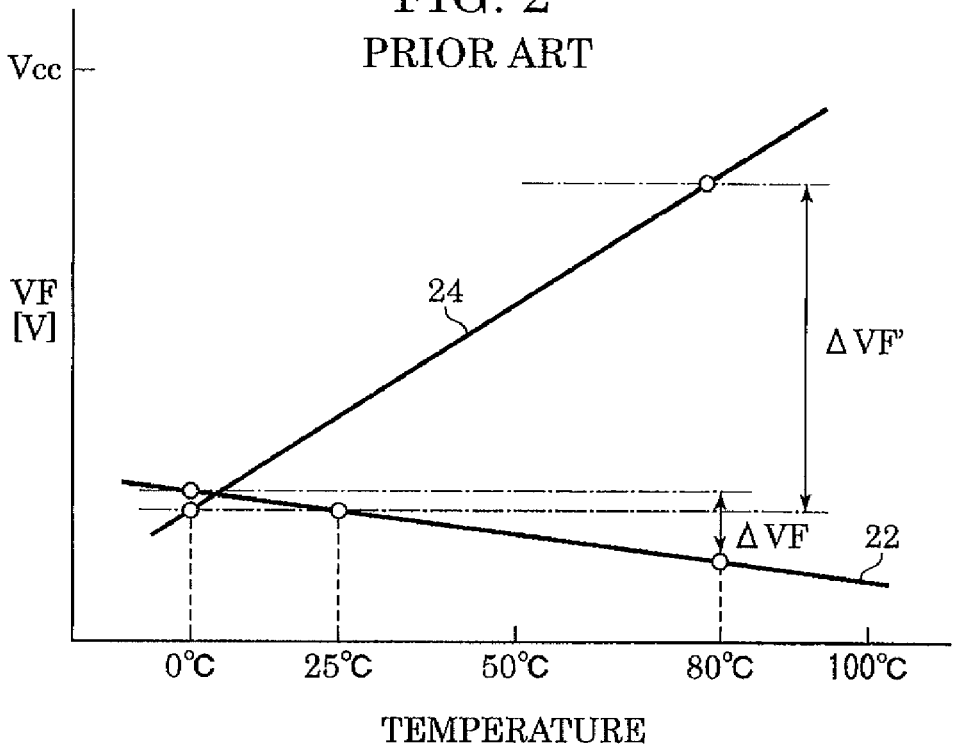
FIG. 2 PRIOR ART
FIG. 2 is a graph showing the temperature characteristic of the circuit shown in FIG. 1 and that of the diode sensor alone.
Figure 3:
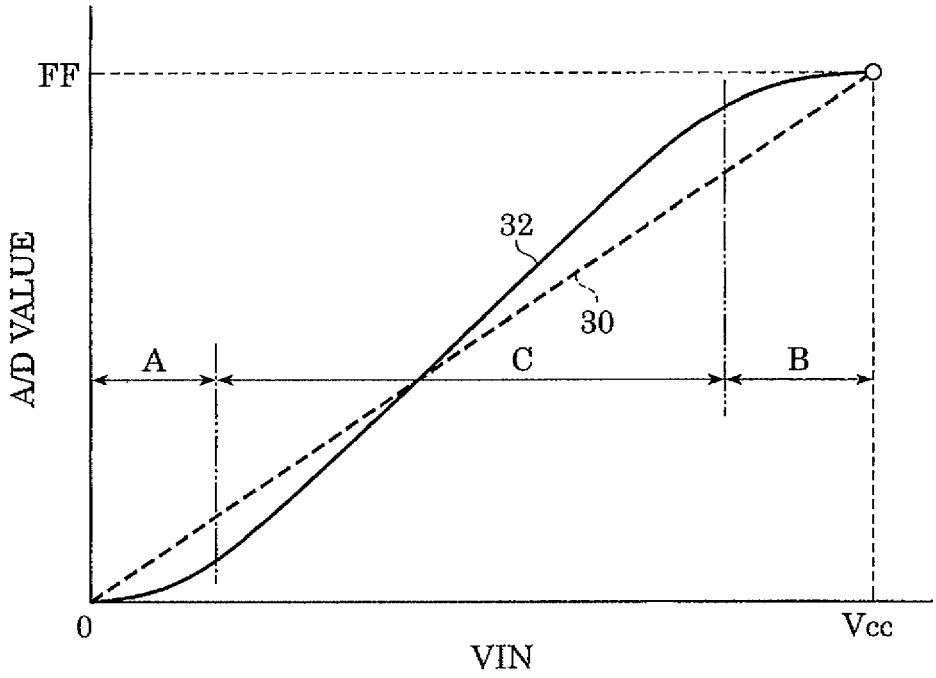
FIG. 3 is a graph showing, by comparison, an example of the characteristic of an ideal A/D converter and that of the characteristic of a low-cost A/D converter.

Next, the reason why it was assumed in the above description that R42=R44, will be explained below. As described above with reference to FIG. 3, regarding the conversion characteristic of a low-cost A/D converter, i.e., the relationship of the digitally converted value to the analog input voltage of this converter, the A/D converter maintains the linearity in the vicinity of the center of the dynamic range, but tends to lose the linearity in the regions near the power supply voltages, i.e., near 0 V and Vcc. In this embodiment, in order to avoid this loss in linearity, the region near the center of the dynamic range, where the A/D converter exhibits an excellent linearity, is employed, thereby enhancing the detection accuracy with respect to the voltage drop VF in the diode censor with an inexpensive arrangement. In this case, substantially equating the two resistance values of R42 and R44 is easier to set the two input voltages near the center of the dynamic range than otherwise would be the case.

Figures 5, 6:
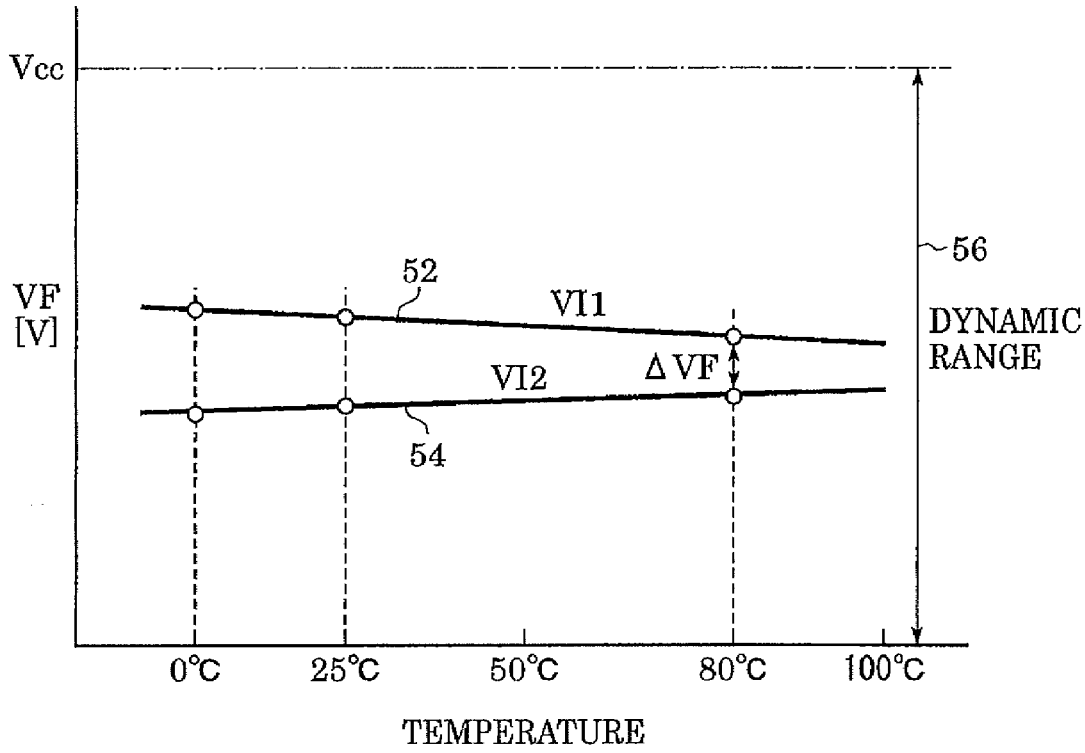
FIG. 5 is a diagram showing signals outputted from the circuit shown in FIG. 4.
FIG. 6 shows an example of a lookup table for determining the temperature from the difference voltage ΔVF.

FIG. 5 is a diagram showing signals outputted from the circuit shown in FIG. 4. In FIG. 5, a straight line 52 indicates the input voltage VI1 to a channel 1 (CH1) of the A/D converter, and a straight line 54 indicates the input voltage VI2 to a channel 2 (CH2) of the A/D converter. As illustrated in FIG. 5, these two input voltages are designed to come near the center of the dynamic range 56 of the A/D converter.

FIG. 6 shows an example of a lookup table for converting the detected difference voltage (variation) ΔVF into a temperature value [° C.]. As is well known to persons skilled in the art, such a lookup table can be easily implemented by hardware or software.

Instead of using a lookup table as shown in FIG. 6, calculation may be performed with software to determine the temperature value [° C.] from a linear equation using the difference voltage ΔVF as a variable.

The circuit shown in FIG. 4 has an advantage of being less susceptible to common mode noise. Referring again to FIG. 4, the signal lines 45 and 46, respectively, disposed on the anode side and cathode side, are usually introduced from the recording head to respective input terminals of the A/D converter so as to be located adjacent to each other. In both signal lines 45 and 46, therefore, common-mode signal noises 47 and 48 having similar waveforms to each other are prone to be induced. At this time, voltages VI1 and VI2 on which the signal noises 47 and 48 are superimposed, respectively, are inputted into the channels 1 and 2 of the A/D converter, respectively. However, by virtue of the feature of this embodiment, the voltage drop VF in the diode sensor is determined from the difference voltage between the two input voltages VI1 and VI2 on which common mode components having similar waveforms are superimposed, thereby eventually canceling out common-mode noise components.

From the foregoing, it will become apparent to persons skilled in the art that the circuit shown in FIG. 4 is less subject to common mode noise.

Other Embodiments

In the above-described explanations, a temperature sensor using a diode has been exemplified. However, the material for a temperature sensor is not limited to a diode, but may include a transistor or the like as long as it has a p-n junction. Also, as a temperature sensor, not only one formed on the heater board together with a discharge heater as described above, but also one formed separately therefrom may be employed. Alternatively, the temperature sensor does not necessarily require to be formed on the heater board. Still alternatively, an appropriate number of temperature sensors may be formed at appropriate locations of the recording head. Furthermore, function elements such as the temperature sensor, resistors, A/D converter may be formed on the substrate identical to that for the recording element in the recording head.

Moreover, in the above-described explanations, the case where the present invention is used for the temperature detection for an ink jet recording head that performs recording by discharging ink using electrothermal transducers (discharge heaters) has been taken as an example. However, the present invention is also applicable to other types of recording heads and recording devices as long as they perform recording using thermal energy, for example, like a thermal recording head.

In addition, the recording device according to the present invention may be used in the form of a copying machine combined with a reader and the like, or a facsimile device having a transmission/reception function in addition to an image output terminal of an information processing device such as a computer, the image output terminal being installed integrally with or separately from the information processing device.

According to the above-described example, it is possible to correctly determine the temperature inside the recording head taking advantage of the temperature characteristic of the voltage drop in the p-n junction, with a simple and inexpensive construction.

Furthermore, since the voltage values on both of the P-side and N-side are converted into digital data before the difference data between the two voltage values is determined, the diode sensor 40 becomes less susceptible to common mode noise.

while the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording device having a recording head operable to perform recording using thermal energy, the recording device comprising:

a sensor having a p-n junction of a semiconductor and being disposed inside the recording head, wherein the p-n junction includes a P-side portion and a N-side portion;

an analog/digital converter converting a first voltage value at the P-side portion into a first digital data and converting a second voltage value at the N-side portion into a second digital data;

a difference calculator calculating a difference data of the first and second digital data; and a temperature determining means for determining a temperature of the recording head, wherein the temperature determining means includes a lookup table that defines correlations between the difference data and the temperature of the recording head.

* * * * *